United States Patent [19]

King

[11] 4,186,717

[45] Feb. 5, 1980

[54] STOVE STRUCTURE

[75] Inventor: John M. King, Yorktown, Va.

[73] Assignee: KBS Enterprises, Newport News, Va.

[21] Appl. No.: 869,764

[22] Filed: Jan. 16, 1978

[51] Int. Cl.[2] ..... F24B 3/00

[52] U.S. Cl. ..... 126/66

[58] Field of Search ..... 126/66, 60, 61, 62, 126/63, 64

[56] References Cited

U.S. PATENT DOCUMENTS

| | | | |
|---|---|---|---|
| 28,390 | 5/1860 | McMillen | 126/62 |
| 187,999 | 3/1877 | Brunnert | 126/64 |
| 4,015,579 | 4/1977 | Wirth et al. | 126/63 |
| 4,092,976 | 6/1978 | Buckner | 126/66 |

*Primary Examiner*—Samuel Scott
*Assistant Examiner*—Wesley S. Ratliff, Jr.
*Attorney, Agent, or Firm*—Cushman, Darby & Cushman

[57] ABSTRACT

A wood burning stove having an enclosure in which is located a first, V-shaped baffle plate extending horizontally from the front wall of the enclosure but spaced from the rear wall thereof, a second flat baffle plate having a rear edge in engagement with the rear wall of the stove enclosure and extending across the enclosure with the front edge thereof spaced from the interior of the front wall of the stove to define a vent space leading from the rear of the enclosure over the top of the V-shaped baffle plate, up the front wall and then back towards the rear wall over the top of the second, flat baffle plate to a flue opening, side air channels are provided to heat room air.

6 Claims, 4 Drawing Figures

STOVE STRUCTURE

BACKGROUND AND SUMMARY OF THE INVENTION

The present invention relates to stoves of the type that can be usefully employed to burn wood or coal and which will supply substantially more heat than previously employed stoves of this nature.

With the increasing scarcity of fossil fuels, utility companies have, in recent times, increased their rates thus rendering home heating units of the gas or electrical type relatively expensive to operate. Homeowners have, therefore, turned their attention to less expensive alternatives to electric, gas or oil heaters and particular attention has been directed to the use of wood or coal burning stoves. However, the use of such stoves of the prior art has failed to provide adequate heating for contemporary dwellings which are characterized by large open spaces and such stoves have been plagued by the problems of smoke and soot accumulation in the room or rooms being heated, thus discouraging the use of such stoves or limiting their usefulness to recreational as opposed to the residential type of dwellings.

Some stove structures such as that disclosed in U.S. Pat. No. 2,058,094 of Oct. 20, 1936, have endeavored to improve heat transfer from the burning fuel to the ambient air by employing complicated ducting arrangements. In addition to the significant increase in manufacturing cost that result from such structures, often other difficulties result such as localized hot spots on the exterior walls of the stove and the localized accumulation of soot on the interior surfaces of the stove which are both inconvenient and often difficult to clean.

It is an object of the present invention to provide a stove structure which avoids the foregoing difficulties and yet one which is relatively inexpensive to manufacture, both in terms of the materials and labor involved.

In a preferred embodiment, the object of the present invention is attained by providing, in a stove enclosure, a first V-shaped baffle plate which extends from the front wall of the enclosure towards the rear wall thereof but is spaced a distance from the rear wall and a second, flat baffle plate which vertically overlies a portion of the V-shaped plate but which extends from the rear wall towards the front wall of the stove enclosure but falls short of the front wall to thereby define a vent path which both greatly increases the quantitiy of heat that is transmitted to the radiating exterior surfaces of the stove enclosure, before reaching the flue vent, but which also substantially reduces the accumulation of soot and other types of refuse on the interior surfaces of the stove. In addition, side air channels are provided which function to draw in room air, circulate it through the channels and return it to the front of the stove, at which point the heated air is returned to the surrounding spaces for the purpose of heating same.

A more complete understanding of the present invention and the advantages attendant to the use thereof will be gained by a consideration of the following detailed description taken in conjunction with the accompanying drawings, in which:

DETAILED DESCRIPTION OF THE INVENTION

Figure 1:
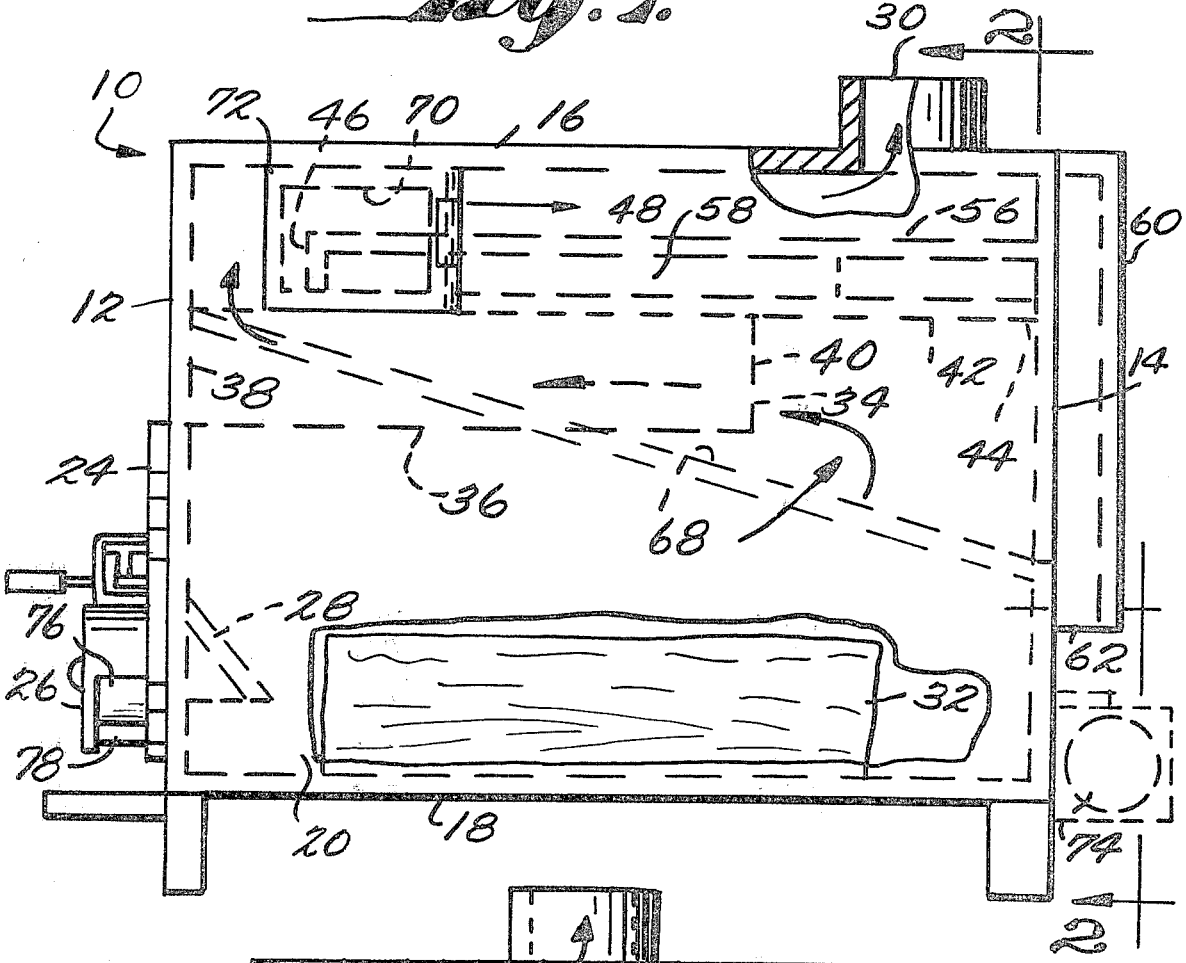
FIG. 1 is a side view in elevation, with parts broken away, showing one embodiment of the stove structure of the present invention.
Figure 2:
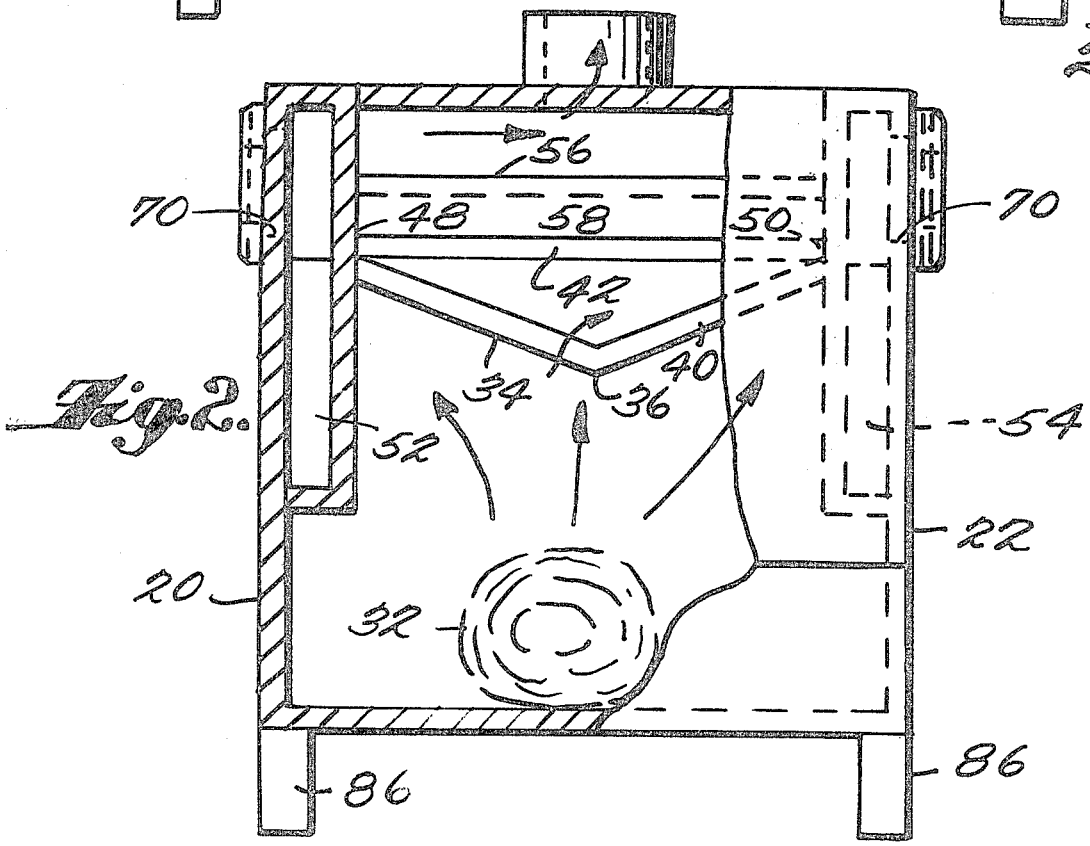
FIG. 2 is a view taken along lines 2—2 of FIG. 1.
Figure 3:
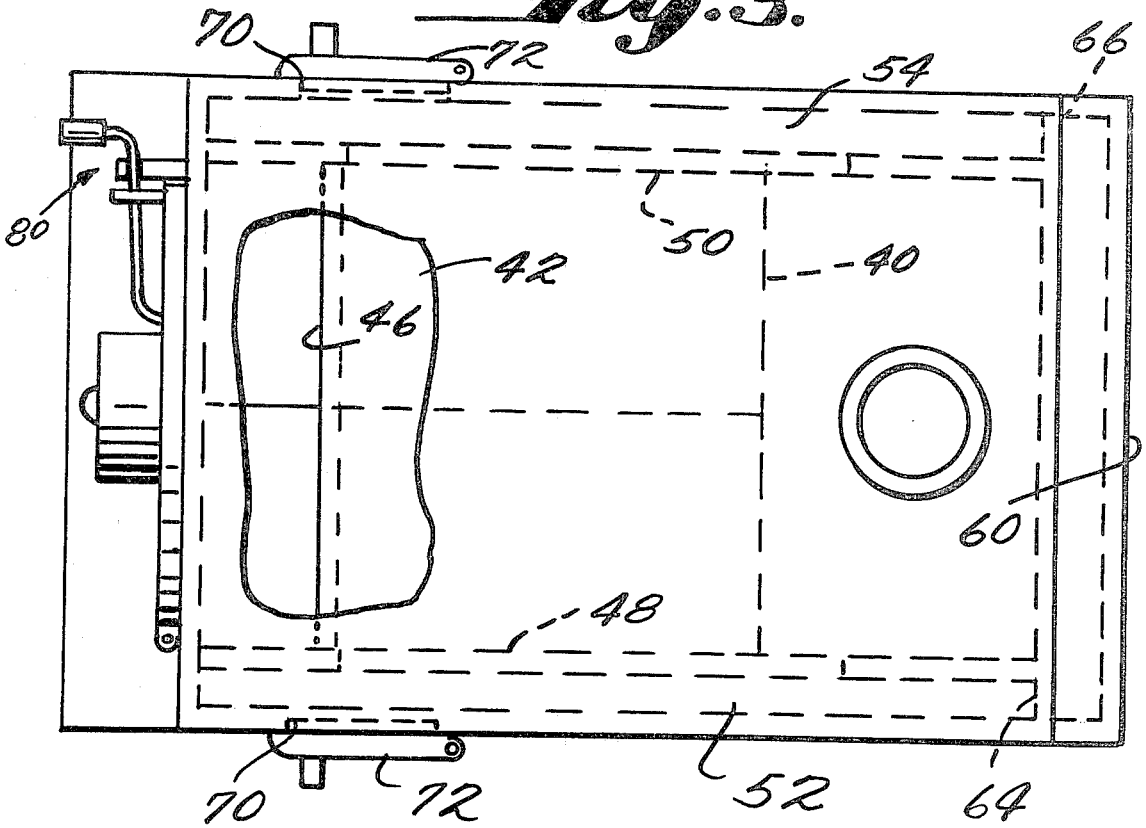
FIG. 3 is a top plan view of the stove structure of FIG. 1.
Figure 4:
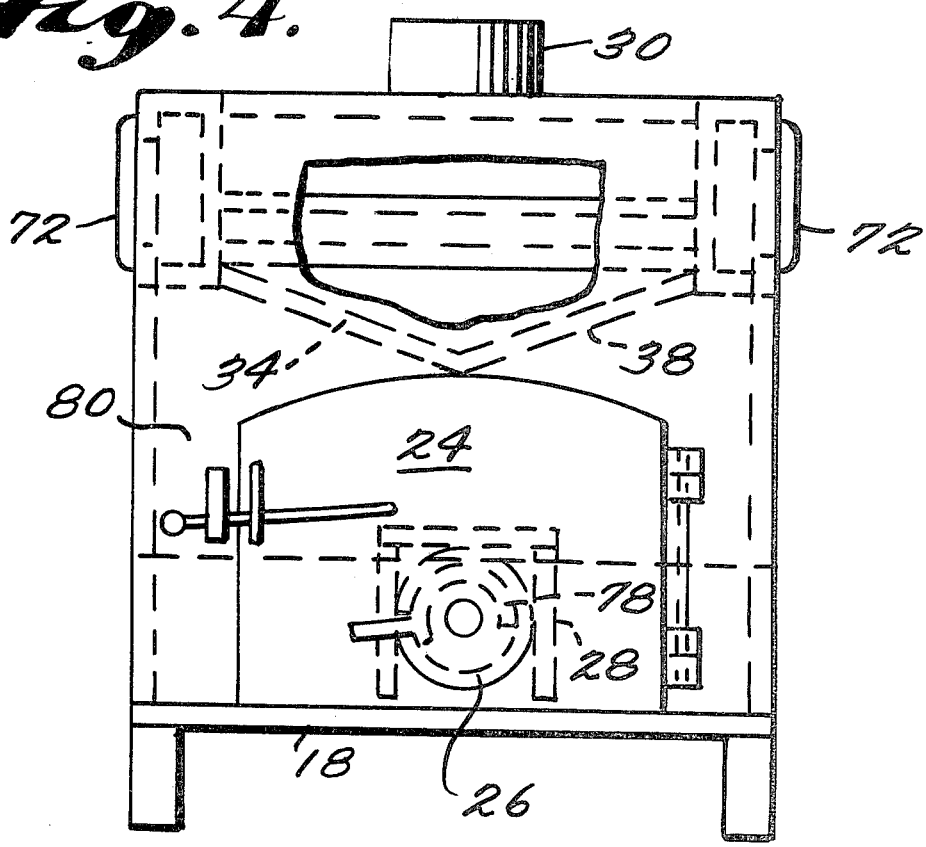
FIG. 4 is a front view in elevation, with parts broken away, of the stove structure of FIG. 1.

Referring now to FIG. 1, there is shown, generally designated at 10, a stove according to the present invention which has a front wall 12, a rear wall 14, a top wall 16, a bottom wall 18 and two side walls 20, shown in FIG. 1, and 22 which appears in FIGS. 2–4.

Front wall 12 has the usual gate or closure 24 which can be conventionally mounted on the front wall 12 such as by interengaging hinges and a hinge pin so that closure 24 can swing about a vertical axis to permit access to the interior of the stove enclosure 10. Preferably, the closure 24 is provided with an air lock 26 which facilitates the admission of fresh air into the interior of the stove 10. Additionally, a diverting baffle 28 surrounds the inlet port for the air lock 26 to transfer air evenly across the entire floor of the stove for even combustion of the material. It will be appreciated by those skilled in the art that the closure 24 and air lock 26 should be constructed so as to minimize the loss of heat and passage of air through these openings except in the controlled manner through the air lock 26 so that the combustion occurring in the stove can be regulated as explained below.

The interior of the bottom wall 18 of the stove 10 may be lined with a refractory material (not shown) as this wall supports the fuel 32 during combustion thereof.

According to the present invention, a first baffle means in the form of a V-shaped plate 34 is employed to distribute the heat rising from the burning fuel 32 towards the side walls 20 and 22 of the enclosure. The low point or bottom edge 36 of the plate 34 should extend generally horizontally and lie at approximately the midpoint between side walls 20 and 22 with the sides of the plate 34 rising gradually towards the side walls 20 and 22. The front edge 38 of the V-shaped plate 34 should be rigidly secured as by welding to the interior side of the front wall 12 of the stove so that no air, gases or smoke can pass between the V-shaped plate 34 and the front wall 12. The rear edge 40 of the plate 34 is spaced a distance from the interior side of rear wall 14 as shown clearly in FIGS. 1 and 3. The side edges of plate 34 should also be sealed as by welding to the interior surface.

A second baffle means in the form of a flat plate 42 has a rear edge 44 secured to the interior side of rear wall 14 so that plate 42 extends generally perpendicularly from rear wall 14 towards the front wall 12 as more clearly shown in FIG. 3 and is vertically spaced from the first baffle means 34. The front edge 46 of plate 42 is spaced a selected distance from the interior side of front wall 12 while the side edges 48 and 50 of plate 42 are secured and sealed to the interior sides of air channel ducts 52 and 54, respectively, the function of which will be described below. In the embodiment of FIGS. 1–4, a second flat plate 56 which is co-extensive with plate 42, but is spaced vertically above plate 42, is employed to provide a chamber 58 which is in flow communication with the air channel ducts 52 and 54, respectively. The side edges of plates 42 and 56 are sealed as by welding to the side walls of air channel ducts 52 and 54 so that no combustion products can enter into the space 58.

Mounted on the rear wall 14 of the stove 10 is a downwardly opening enclosure 60. The bottom side 62 of enclosure 60 is open so that air, as it is heated in the side channel ducts 52 and 54 will move upwardly to draw in cooler room air through opening 62 into the side channel ducts 54 at their entrance points 64 and 66, respectively. As shown more clearly in FIG. 1, the bottom wall 68 of air channel duct 52 slopes upwardly from the rear wall 14 to the front wall 12 thus decreasing the cross sectional area of the duct gradually as measured from the rear wall to the front wall of the stove 10. The same is true of the other air channel duct 54. Adjacent the front wall 12 a side vent 70 is provided in each of the air channel ducts, through which opening hot air can escape to the space being heated when the doors 72 are opened. It will be noted that the hinge axis for each of the doors 72 is located to one side of the vent 70 so that the vents are between the hinge axis and the front wall 12. With this arrangement, by properly setting the doors 72 with respect to the opening 70, the flow of hot air may be directed, as desired, into the room. To assist in circulation, a blower 74 which may be electrically powered may be mounted below the opening 62 in enclosure 60 to force room air into the air channel ducts 52 and 54.

With the baffle arrangement of this invention, it will be appreciated that a vent path is created for the combustion products within the enclosure 10 where the flow is in the direction of the arrows depicted in FIG. 1 for the combustion products. It is believed that, as shown in FIG. 2, the hottest temperature in the enclosure, apart from the burning material itself, will be the area between the sloping sides of plate 34 and the interior walls of the air ducts 52 and 54. This will maximize the transfer of heat to the room air being circulated through the channel ducts 52 and 54.

The stove 10 is operated in a conventional manner by opening the closure 24 and inserting combustible material such as logs or coal into the interior of the closure as at 32 and then igniting same. The air lock 26 has an opening 76, the size of which can be regulated by a rotary slide panel 78 to control the admission of air through the wall of the closure 24 to the interior of the stove 10. After combustion has been initiated, the closure 24 is closed as by a suitable mechanism 80 shown in FIGS. 3 and 4, which may simply comprise a suitable latch or a sliding bolt arrangement.

In each of the foregoing embodiments, it is desirable that the stove enclosures be spaced from the floor such as by legs 86 to thereby permit room air to pass under the stove and be drawn into the enclosure 60 through bottom side 62 and thence to the laterally located air channel ducts 52 and 54.

One of the advantages of the overall arrangement of the stove as described above is that the flue 30 may be located in a fireplace directly in line with the chimney flue with the front of the stove protruding into the room from the fireplace. Thus, in homes equipped with fireplaces, the stoves of the present invention can be easily and inexpensively installed without the necessity of employing additional duct work for the stove vent.

Having described the invention, it will be apparent that various modifications may be made therein without departing from the spirit of the present invention as defined in the appended claims.

What is claimed is:

1. A stove comprising an enclosure having a front wall, a rear, a bottom, a top and side walls, closure means on said front wall for allowing access to the interior of said enclosure, a flue opening in said top wall adjacent said rear wall, a V-shaped baffle plate having a front edge secured to the interior of said front wall so as to prevent passage of air therebetween, a rear edge spaced a distance from said rear wall of said enclosure, side edges secured in an airtight manner to each respective side wall of said enclosure and an edge vertically lower than said side edges defining the base of the "V" located at substantially the midpoint between said side walls and extending generally perpendicular to said front wall, said V-shaped baffle plate being disposed closer to said top wall than to said bottom wall of said enclosure so that the heat and gas flow that reaches said V-shaped baffle plate from a combustion source supported on said bottom wall will be directed toward each said side wall, baffle wall means located at least partly above said V-shaped baffle plate for defining a vent path extending from between said V-shaped baffle plate and said rear wall, between said V-shaped baffle plate and said baffle wall means toward said front wall and, then, from said front wall between said top wall and said baffle wall means toward said flue opening, said stove further comprising air channel means on each side wall extending from said rear wall toward said front wall, said air channel means being open to room air at said rear wall and having vent means adjacent said front wall, each air channel means having a vertical dimension that decreases progressively from said rear wall to said front wall, and said rear wall of said stove having a chamber mounted thereon, the interior of which is open to each said air channel means, said chamber having an opening to room air located vertically below the point where said air channel means are open to room air.

2. The stove as claimed in claim 1 wherein said vent means are openings formed in each said side wall, each said opening having a movable closure member secured to the associated side wall with the opening disposed between said closure member and said front wall.

3. The stove as claimed in claim 1 wherein said baffle wall means is a flat plate having a rear edge in engagement with said rear wall of said enclosure, a front edge spaced a distance from said front wall of said enclosure and side edges in engagement with said side walls of said enclosure.

4. The stove as claimed in claim 3, wherein a said side edge of said flat plate extends parallel to a said side edge of said V-shaped plate and adjacent thereto.

5. The stove as claimed in claim 3 wherein said baffle wall means further includes another flat plate spaced vertically from said first-mentioned flat plate and extending parallel thereto, said another flat plate having a front edge with a wall extending between said front edges of said flat plates, said another flat plate also having side edges with the space between said side edges of said flat plates being open, said stove having air channel means on each side wall extending between said rear wall and said front wall, said air channel means being open to room air at said rear wall, each side wall having an opening to said space between said flat plates.

6. The stove as claimed in claim 1, wherein blower means are provided to force air into said air channel means adjacent said rear wall.

* * * * *